US007219392B2

(12) United States Patent
Mullet et al.

(10) Patent No.: US 7,219,392 B2
(45) Date of Patent: May 22, 2007

(54) BREAKAWAY TRACK SYSTEM FOR AN OVERHEAD DOOR

(75) Inventors: Willis J. Mullet, Gulf Breeze, FL (US); Derek S. Paquette, Daphne, AL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 0 days.

(21) Appl. No.: 10/882,701

(22) Filed: Jun. 28, 2004

(65) Prior Publication Data

US 2005/0284586 A1 Dec. 29, 2005

(51) Int. Cl.
*E05D 15/16* (2006.01)

(52) U.S. Cl. ..... 16/96 R; 160/201; 52/98; 29/413

(58) Field of Classification Search ..... 160/201; 49/505; 52/98; 16/96 R; 29/413; 245/909; 248/909

See application file for complete search history.

(56) References Cited

U.S. PATENT DOCUMENTS

| | | | | | |
|---|---|---|---|---|---|
| 2,436,006 | A * | 2/1948 | Kaiser | 160/191 |
| 2,916,159 | A * | 12/1959 | O'Neill | 211/89.01 |
| 4,339,860 | A * | 7/1982 | Hayashi | 29/413 |
| 4,660,333 | A * | 4/1987 | Romer | 52/302.3 |
| 4,916,871 | A * | 4/1990 | Anderson | 52/98 |
| 5,239,777 | A | 8/1993 | Husselton | 49/200 |
| 5,330,066 | A * | 7/1994 | Carroll | 211/189 |
| 5,479,750 | A * | 1/1996 | Carlberg | 52/300 |
| 5,836,499 | A | 11/1998 | Mullet et al. | 226/168 |
| 6,047,761 | A | 4/2000 | Jaehnen et al. | 160/201 |
| 6,089,304 | A | 7/2000 | Mullet et al. | 160/209 |
| 6,527,035 | B2 | 3/2003 | Hoofard et al. | 160/201 |
| 6,554,047 | B1 | 4/2003 | Mondragon et al. | 160/201 |
| 6,644,609 | B1 * | 11/2003 | Scott | 248/243 |
| 6,843,299 | B2 * | 1/2005 | Judkins | 160/178.1 R |
| 2002/0003031 | A1 | 1/2002 | Hoofard et al. | 160/201 |
| 2003/0070771 | A1 | 4/2003 | Hoofard et al. | 160/201 |

FOREIGN PATENT DOCUMENTS

| | | | |
|---|---|---|---|
| CA | 1108198 | 9/1981 | 268/27 |
| WO | WO 03/076749 A1 | 9/2003 | |

* cited by examiner

*Primary Examiner*—Blair M. Johnson
(74) *Attorney, Agent, or Firm*—Renner Kenner Greive Bobak Taylor & Weber

(57) ABSTRACT

An overhead garage door (10) includes a plurality of panels (11) each carrying rollers (12) which ride in a track assembly (15). The track assembly (15) includes a generally vertically positionable component (16), a generally horizontally positionable component (17), and an arcuate transitional component (18) positioned between the vertical component (16) and the horizontal component (17). The vertical component (16) is generally U-shaped in end profile having a base portion (22) with branches (20, 21) extending from the edges thereof. The vertical component (16) is provided with a plurality of spaced separating systems (25), each of which includes a web (26) extending across the base portion (22) and the slots (28, 29) in the branches (20, 21). A selected portion of the length of the vertical component (16) may be removed by inserting a tool in the slots (28, 29) of one of the separating systems (25) and twisting it to break the webs (30, 31) adjacent to the slots (28, 29). Then by bending that portion on the web (26), it will breakaway to provide a vertical component (16) of the desired length.

10 Claims, 3 Drawing Sheets

BREAKAWAY TRACK SYSTEM FOR AN OVERHEAD DOOR

TECHNICAL FIELD

This invention relates to a track system for sectional overhead doors such as garage doors and the like. More specifically, this invention relates to such a system wherein the height of the vertical component thereof may be varied to accommodate various installation height restraints.

BACKGROUND ART

Overhead sectional doors, such as garage doors and the like, are typically provided with rollers that ride in a track system usually carried by a horizontally oriented angle member extending inwardly from the door frame. The track system includes opposed vertically oriented tracks and opposed horizontally oriented tracks interconnected by an arcuate transitional track. When the door is in the closed position, the rollers reside in the opposed vertical tracks, and when moved to the open position, the rollers travel up the vertical tracks, through the transitional tracks, and into the opposed horizontal tracks.

The amount of headroom in the garage or other area to receive the door generally dictates the length of the vertically oriented tracks. As such, a door installer must carry an inventory of vertical tracks of different lengths and transport tracks of all possible lengths with him to the installation site where, during the installation process, he will determine which vertical track length is most appropriate for the particular job. Maintaining and transporting such an inventory represents an undesirable cost and labor burden to the installer which is a problem unsolved by the prior art.

DISCLOSURE OF THE INVENTION

It is thus an object of the present invention to provide a track system for an overhead door in which the height of the vertical portion of the tracks may be adjusted.

It is another object of the present invention to provide a track system, as above, which eliminates the necessity of maintaining and transporting an inventory of tracks of various lengths to accommodate installation areas of differing headrooms.

It is a further object of the present invention to provide a track system, as above, which minimizes door installation time.

These and other objects of the present invention, as well as the advantages thereof over existing prior art forms, which will become apparent from the description to follow, are accomplished by the improvements hereinafter described and claimed.

In general, a track assembly for an overhead door made in accordance with the present invention includes a track component having a length. The track component is provided with a plurality of separating systems spaced along its length so that a selected portion of the length of the component can be removed.

A method of adjusting the length of a track component having a plurality of separating systems spaced along its length includes the steps of determining the desired length of the component, and utilizing the appropriate separating system to adjust the length of the component to the desired length.

An overhead door made in accordance with the present invention includes a plurality of panels each carrying rollers.

The rollers are received in a track system which includes a generally vertical track component, a generally horizontal track component, and an arcuate track component between the vertical track component and the horizontal track component. The vertical track component includes spaced separating systems so that a selected portion of the vertical track component may be removed from the remainder of the vertical track component.

A preferred exemplary track system for an overhead door according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
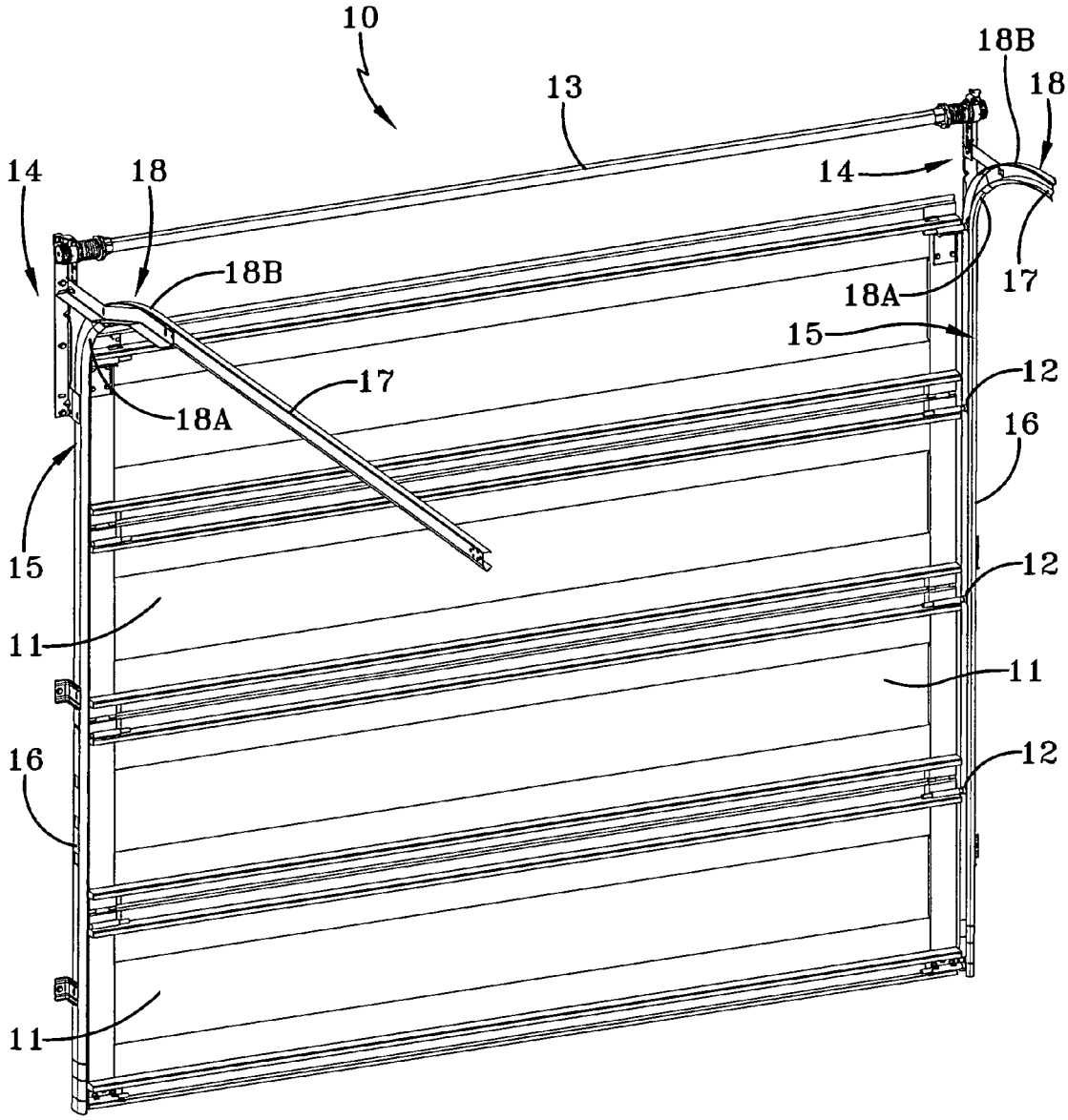
FIG. 1 is a fragmentary perspective view of a sectional overhead door having a track assembly made in accordance with the concepts of the present invention.

An overhead-type garage door is indicated generally by the numeral 10 and includes a plurality of panels 11, each having guide rollers 12 positioned on the opposed lateral edges thereof. Door 10 is interconnected, in a conventional manner, to a counterbalance system 13 which is schematically shown in FIG. 1. Conventional bracket assemblies, generally indicated by the numeral 14, are mounted on door jambs (not shown), and each bracket assembly 14 carries, in a conventional manner, a track assembly generally indicated by the numeral 15.

Track assemblies 15 are generally identical and receive rollers 12 therein. Each track assembly 15 includes a generally vertically positionable track component or segment 16 and a generally horizontally positionable track component or segment 17. An arcuate transition track component, generally indicated by the numeral 18, is positioned between vertical track component 16 and horizontal track component 17. Transition track component 18 can be a separate track element attached at its ends to vertical track component 16 and horizontal track component 17, or it can be integrally formed with either track component 16 or 17. Additionally, a portion of the transition track component 18 can be integrally formed with each track component 16 and 17. In this manner, as shown, transition track component 18 can be formed with dual radii of curvature, with vertical track component 16 carrying radiused track 18A and horizontal track component 17 carrying radiused track 18B. Preferably, the radius of curvature of track 18A is smaller than that of track 18B, as more fully described in U.S. patent application Ser. No. 10/421,189 to which reference is made for a complete understanding of the advantages of such a system.

Figure 4:
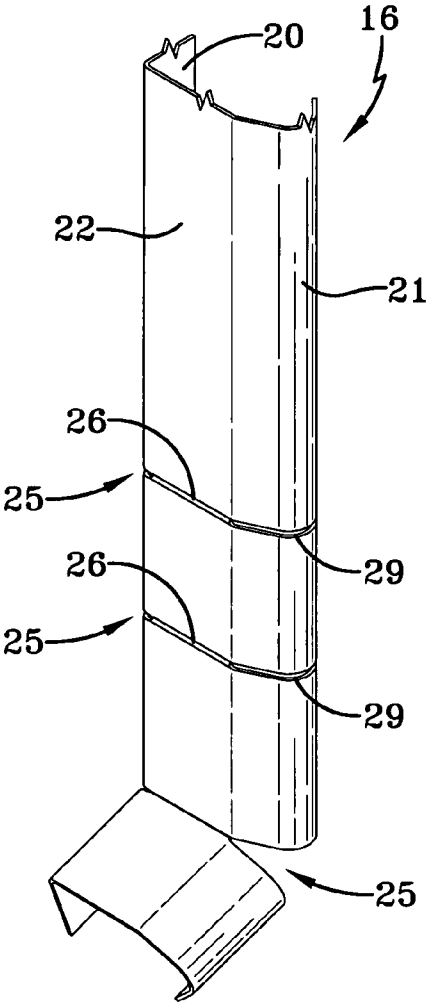
FIG. 4 is a fragmentary perspective view similar to FIG. 3 but showing a portion of a vertical track component broken away.
Figure 3:
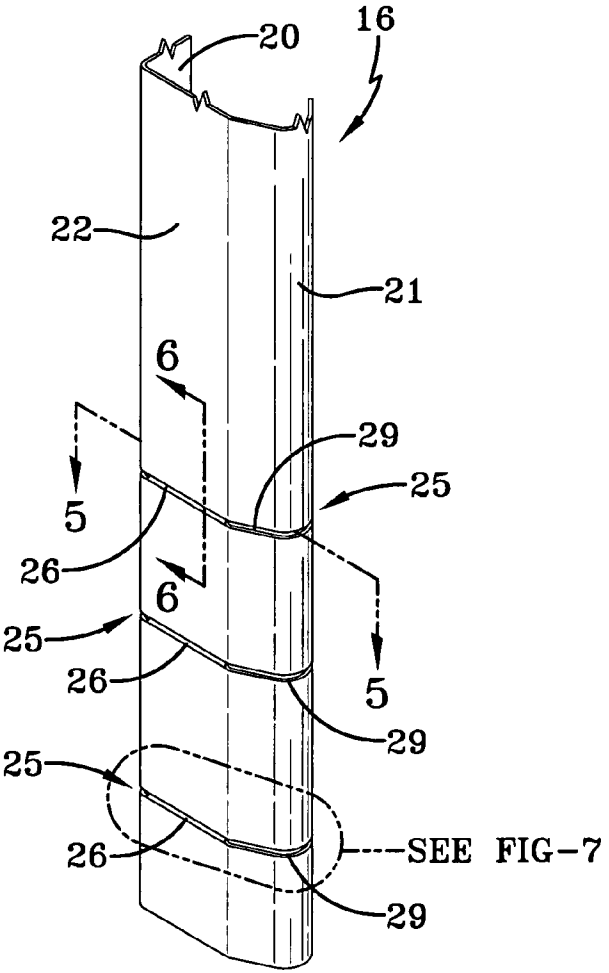
FIG. 3 is a fragmentary perspective view generally showing the outside of a portion of a vertical component of the track assembly of the present invention.
Figure 2:
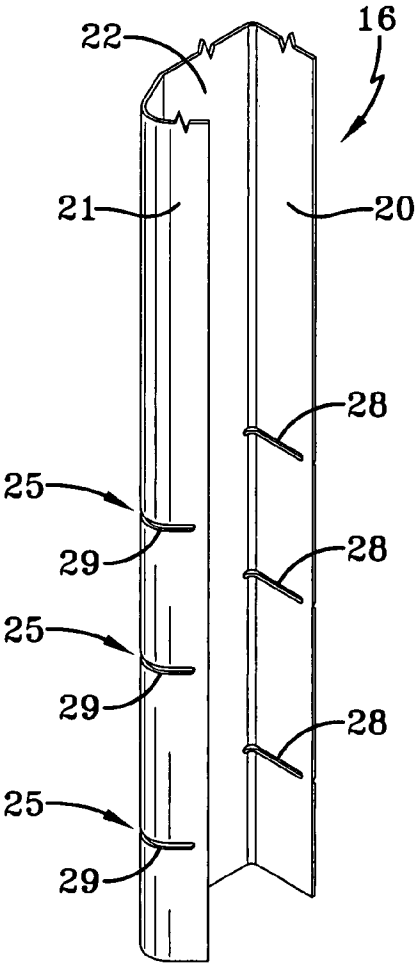
FIG. 2 is a fragmentary perspective view generally showing the inside of a portion of a vertical component of the track assembly of the present invention.
Figure 7:
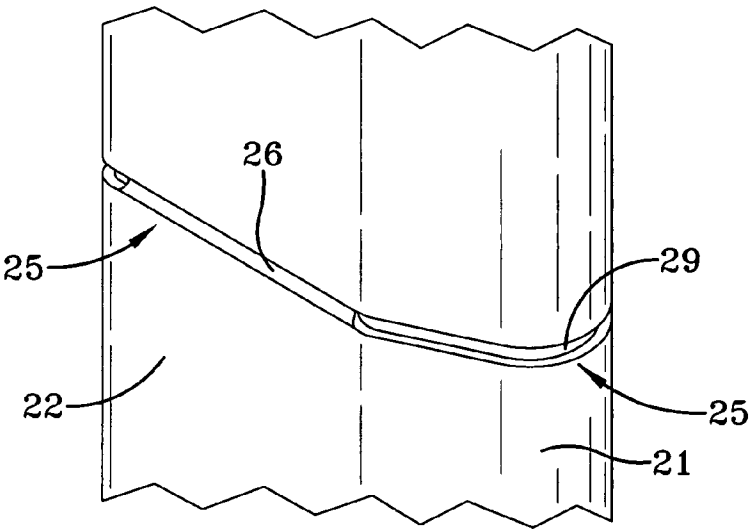
FIG. 7 is an enlarged, fragmentary perspective view of a portion of that which is shown in FIG. 3.
Figure 6:
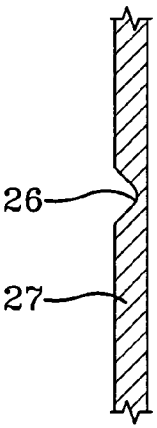
FIG. 6 is an enlarged, fragmentary sectional view taken substantially along line 6—6 of FIG. 3.
Figure 5:
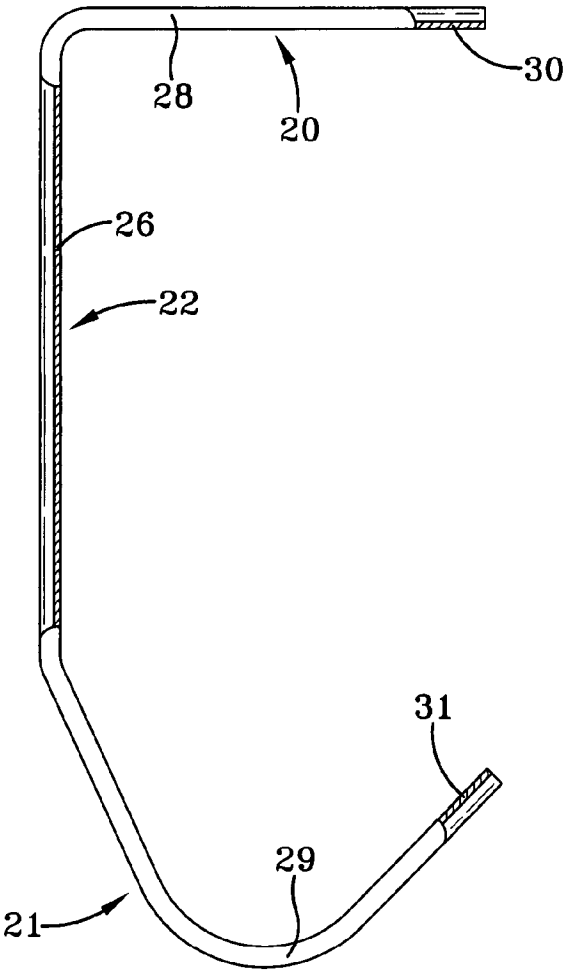
FIG. 5 is an enlarged sectional view taken substantially along line 5—5 of FIG. 3.

The configuration of each vertical track component 16, and specifically the bottom thereof, is shown in FIGS. 2–4. As can be seen, vertical track component 16 is generally U-shaped in end profile having opposed branches 20 and 21 interconnected by a base portion 22. As such, rollers 12 are adapted to be received between branches 20 and 21. As best shown in FIG. 5, branch 20 is preferably a straight or planar member, and opposed branch 21 is generally J-shaped or hook-shaped.

The bottom of each vertical track component 16 is provided with a plurality of vertically spaced separating systems generally indicated by the numeral 25. As will now be described, each separating system 25 allows a predetermined portion of vertical track component 16 to be removed. As a result, the user can shorten track component 16 to a desired length. While three separating systems 25 are shown, essentially any number of separating systems spaced at any desired distance could be provided without departing from the concepts of the present invention. Moreover, although the separating systems 25 are shown and described herein in conjunction with the vertical track component 16, it should be evident that such systems 25 could also be utilized with the horizontal track components 17 should there be a need to adjust the length thereof.

Although the separating systems contemplated herein could be of any configuration which weakens the vertical track components 16 relative to vertical forces, but not the horizontal forces that a vertical track normally encounters, each separating system 25 preferably includes a weakened area forming a web 26 formed across at least a portion of base portion 22 of track component 16. Web 26 is formed by coining or compressing the wall 27 of base portion 22 to a thickness of approximately thirty to fifty percent of its original thickness. Each system 25 also preferably includes a slot 28 formed in branch 20, and a slot 29 formed in branch 21 of track component 16, both slots 28 and 29 being formed generally in the same plane as web 26 and extending through, or substantially through, the material. Slot 28 extends generally from the end of the weakened area forming web 26, to almost the outer edge of branch 20 leaving only a small web 30 of material at that edge. Similarly, slot 29 extends generally from the other end of the weakened area forming web 26, to almost the outer edge of branch 21 leaving only a small web 31 of material at that edge. Slots 28 and 29 are preferably of a height about two times the thickness of the material of branches 20 and 21.

If the installer of door 10 needs to shorten the vertical track component 16, he first determines the desired extent of such shortening and then selects the appropriate separating system 25 to be utilized to shorten the component 16. Then a tool, such as a flat blade screwdriver, may be inserted into slot 28 and slot 29, and upon twisting that tool, webs 30 and 31 will break—a condition shown in FIG. 4. Thus, as shown, the section to be separated from track component 16 will be "hanging" only on web 26 and by bending that section back and forth on web 26 relative to the remaining component, that section will break away as web 26 is severed.

It should be evident that the installer of a door will be able to utilize the track system disclosed herein advantageously in that he will be able to adjust the length of a track component merely be selecting the appropriate separating system 25 to break away a portion of the component which will result in a track component of the desired length. As such, a track system constructed as described herein, accomplishes at least one of the objects of the present invention and otherwise substantially improves the art.

What is claimed is:

1. A track assembly for an overhead door comprising a track component having a length and a generally U-shaped profile including a base portion carrying spaced branches, and a plurality of separating systems spaced along the length of said component so that a selected portion of the length of said component can be removed, each said separating system including a weakened area extending across at least a portion of said base portion formed by a reduction of material so that said base portion is designed to be broken, each said separating system also including a slot formed in said branches, each said slot extending from approximate said base portion to near the end of said branch leaving a web near the end of each said branch.

2. The track assembly of claim 1 wherein said slots are formed in said branches adjacent to said weakened area of said base portion.

3. The track assembly of claim 1 wherein said weakened area of said base portion is formed by creating a thinner area in the wall of said base portion.

4. The track assembly of claim 3 wherein the weakened area of said base portion is less than approximately fifty percent of the thickness of the wall of said base portion.

5. The track assembly of claim 1 wherein said slots are in the same plane as said weakened area of said base portion.

6. A method of adjusting the length of a track component having a base member and a branch extending outwardly from each end of the base number, the track component also having a plurality of separating systems spaced along its length, each separating system including a weakened area or reduced material formed in the base member, a slot in each branch and a web formed adjacent to each slot, the method comprising the steps of determining the desired length of the component, utilizing the appropriate separating system to adjust the length of the component to the desired length by placing a tool in the slot and twisting the tool to break the webs and to separate a portion of the branch from the remaining branch of the component, and thereafter bending the separated portion relative to the remaining component on the weakened area to break the base member at the weakened area.

7. An overhead door comprising a plurality of panels; rollers carried by said panels; and a track system receiving said rollers; said track system including a generally vertical track component having a generally U-shaped profile including a base portion carrying spaced branches, a generally horizontal track component, and an arcuate track component between said vertical track component and said horizontal track component; said vertical track component including spaced separating systems so that a selected portion of said vertical track component may be removed from the remainder of said vertical track component, each said separating system including a weakened area extending across at least a portion of said base portion and a slot formed in said branches, each said slot extending from said base portion to near the end of said branch leaving a web near the ends of said branches.

8. The overhead door of claim 7 wherein said slots are formed in said branches adjacent to said weakened area of said base portion.

9. The overhead door of claim 7 wherein said arcuate track component includes a first portion having a first radius of curvature carried by said vertical track component and a second portion having a second radius of curvature carried by said horizontal track component.

10. A track assembly for an overhead door comprising a track component having a length, said component having a generally U-shaped profile including a base portion carrying spaced branches, and a plurality of separating systems spaced along the length of said component so that a selected portion of the length of said component can be removed, each said separating system including a weakened area or reduced material formed in said base portion and a slot in said branches extending from approximate said base portion to near the end of each said branch thereby forming a web near the end of each said branch.

* * * * *